US010398918B2

(12) United States Patent
Lin

(10) Patent No.: US 10,398,918 B2
(45) Date of Patent: Sep. 3, 2019

(54) EXERCISE EQUIPMENT

(71) Applicant: Pei-Ta Lin, Changhua (TW)

(72) Inventor: Pei-Ta Lin, Changhua (TW)

( * ) Notice: Subject to any disclaimer, the term of this patent is extended or adjusted under 35 U.S.C. 154(b) by 157 days.

(21) Appl. No.: 15/689,542

(22) Filed: Aug. 29, 2017

(65) Prior Publication Data

US 2018/0200555 A1 Jul. 19, 2018

(30) Foreign Application Priority Data

Jan. 19, 2017 (TW) ..... 106101760 A

(51) Int. Cl.

| | |
|---|---|
| ***A63B 21/00*** | (2006.01) |
| ***A63B 21/02*** | (2006.01) |
| ***A63B 21/04*** | (2006.01) |
| *A63B 23/02* | (2006.01) |
| *A61H 1/02* | (2006.01) |
| *A61H 7/00* | (2006.01) |
| *A63B 23/04* | (2006.01) |
| *A63B 23/00* | (2006.01) |

(52) U.S. Cl.

CPC .... *A63B 21/00047* (2013.01); *A63B 21/0004* (2013.01); *A63B 21/00069* (2013.01); *A63B 21/026* (2013.01); *A63B 21/0428* (2013.01); *A63B 21/4039* (2015.10); *A63B 21/4043* (2015.10); *A61H 1/0292* (2013.01); *A61H 7/001* (2013.01); *A61H 2201/1284* (2013.01); *A61H 2201/1695* (2013.01); *A63B 21/0407* (2013.01); *A63B 21/4033* (2015.10); *A63B 21/4035* (2015.10); *A63B 23/0205* (2013.01); *A63B 23/0488* (2013.01); *A63B 2023/006* (2013.01)

(58) Field of Classification Search

CPC ..... A63B 21/00047; A63B 21/0004; A63B 21/00069; A63B 21/0421; A63B 21/0428; A63B 21/026; A63B 21/4043; A63B 21/4039; A63B 21/4035; A63B 21/4033; A63B 21/00178; A63B 21/0407; A63B 21/0414; A63B 5/08; A63B 2005/085; A61H 1/0292; A61H 2201/1695; A61H 2201/1284; A61H 7/001

See application file for complete search history.

(56) References Cited

U.S. PATENT DOCUMENTS

| | | | | |
|---|---|---|---|---|
| 6,712,742 | B2 * | 3/2004 | Suiter | A63B 21/0004 482/140 |
| 6,926,747 | B2 * | 8/2005 | Udwin | A63B 21/00043 48/126 |
| D585,098 | S * | 1/2009 | Rauwerdink | D21/686 |
| 8,870,727 | B2 | 10/2014 | Palmer | |
| 2003/0045409 | A1 * | 3/2003 | Herbst | A61H 1/0292 482/142 |
| 2007/0167287 | A1 | 7/2007 | Wen | |

* cited by examiner

*Primary Examiner* — Megan Anderson
(74) *Attorney, Agent, or Firm* — Muncy, Geissler, Olds & Lowe, P.C.

(57) ABSTRACT

The exercise equipment includes a base, a resilient element, and a positioning mechanism. The base has two bodies which are selectively movable relatively. The two sides of the resilient element are connected to the two bodies. The positioning mechanism is adapted for operation to control the movement of the two bodies.

10 Claims, 13 Drawing Sheets

EXERCISE EQUIPMENT

BACKGROUND OF THE INVENTION

Field of the Invention

The present invention relates to an exercise equipment.

Description of the Prior Art

Conventional exercise equipments for dorsal stretching are disclosed in U.S. Pat. No. 8,870,727 or patent publication US 2007/0167287.

In U.S. Pat. No. 8,870,727, the plate is kept bending only by the elastic rope. When the plate is pushed downward, the plate will be flat again. If the plate is pushed heavily, the elastic rope may be damaged.

In US 2007/0167287, the plate is restricted by the two racks. The bending of the plate is adjusted by changing the relative positions of the two racks by bolts. However, the bolts bear huge force and are easy to break.

SUMMARY OF THE INVENTION

The main object of the present invention is to provide an exercise equipment having a resilient element for bending and two movable bodies.

To achieve the above and other objects, the exercise equipment includes a base, a resilient element and a positioning mechanism.

The base has two bodies which are selectively movable with respect to each other. The two bodies are able to move along a moving path. Each of the bodies has a support portion on the moving path for leaning against. Two sides of the resilient element are connected to the two bodies respectively, and the resilient element is arc-shaped and protruded. The resilient element and each of the bodies are independent from each other to be single pieces. The positioning mechanism includes a first positioning portion and a second positioning portion which are able to be selectively positioned to each other. The first positioning portion is disposed on one of the bodies. The second positioning portion is disposed on the other one of the bodies. The positioning mechanism is switchable between a locking position and a release position. When the positioning mechanism is located at the locking position, the first positioning portion and the second positioning portion are positioned to each other, and the two bodies are unable to move away from or toward each other along the moving path. When the positioning mechanism is located at the release position, the two bodies are able to move along the moving path freely.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
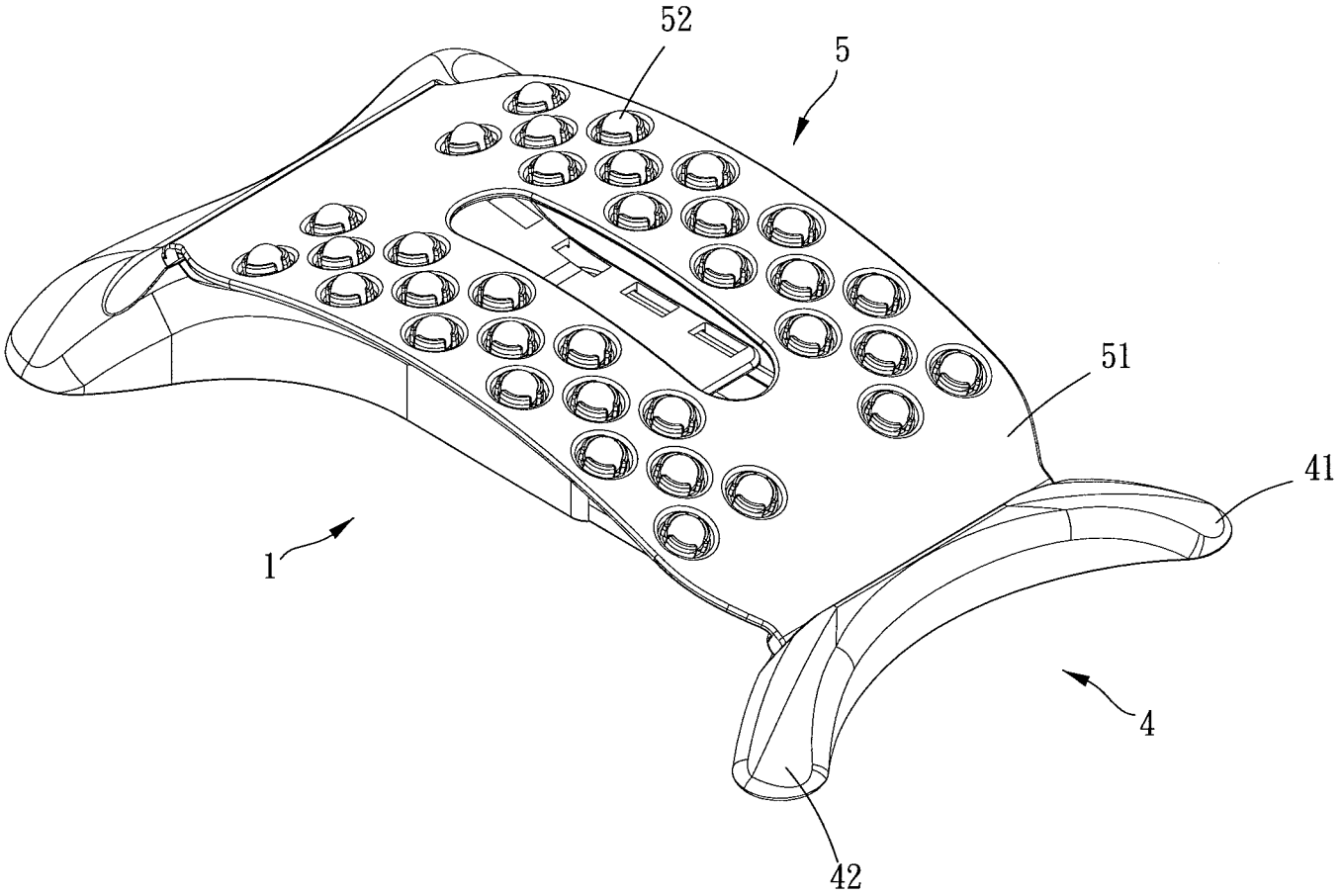
FIGS. 1 and 2 are stereograms of the present invention.
Figure 2:
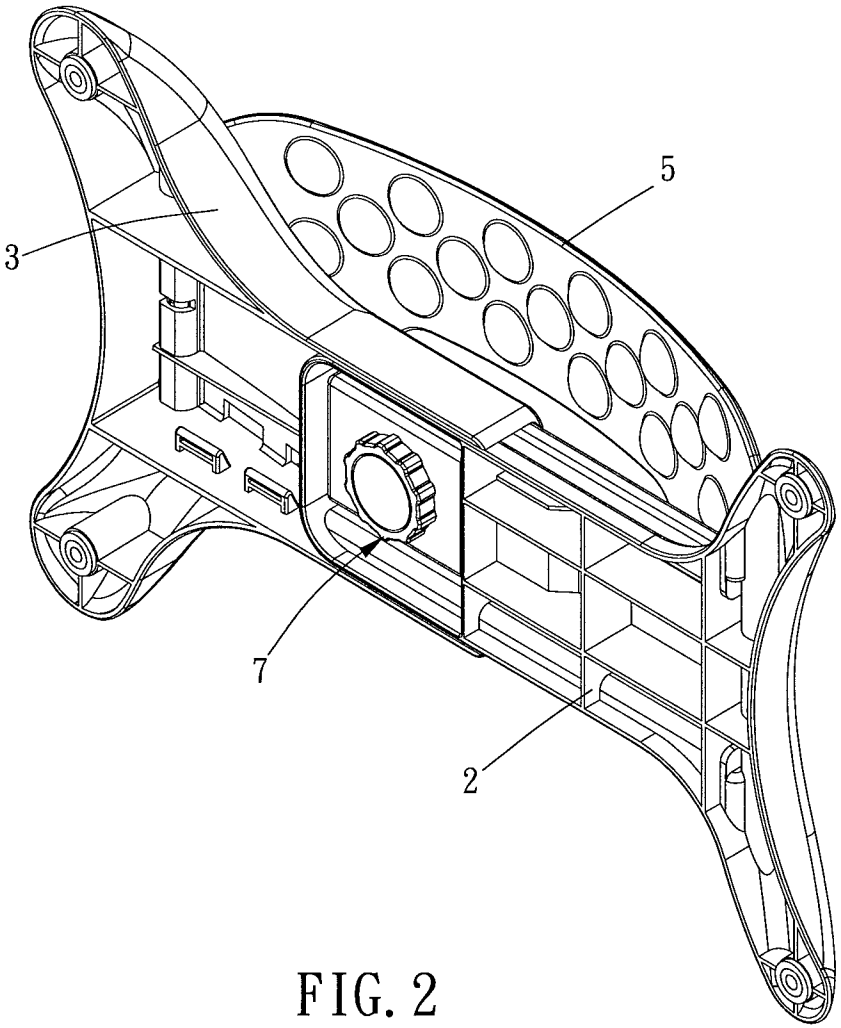
Figure 3:
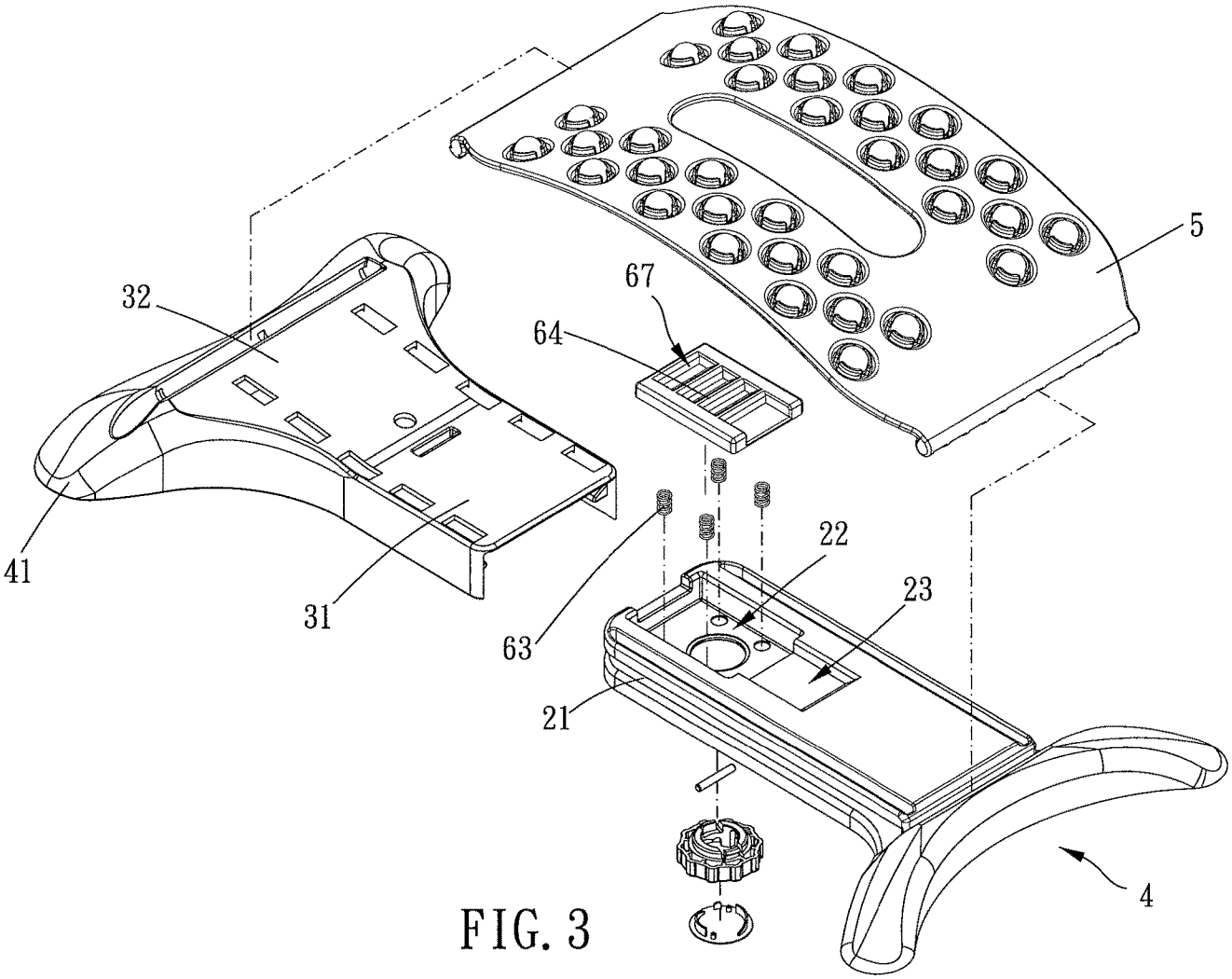
FIGS. 3 and 4 are breakdown drawings of the present invention.
Figure 4:
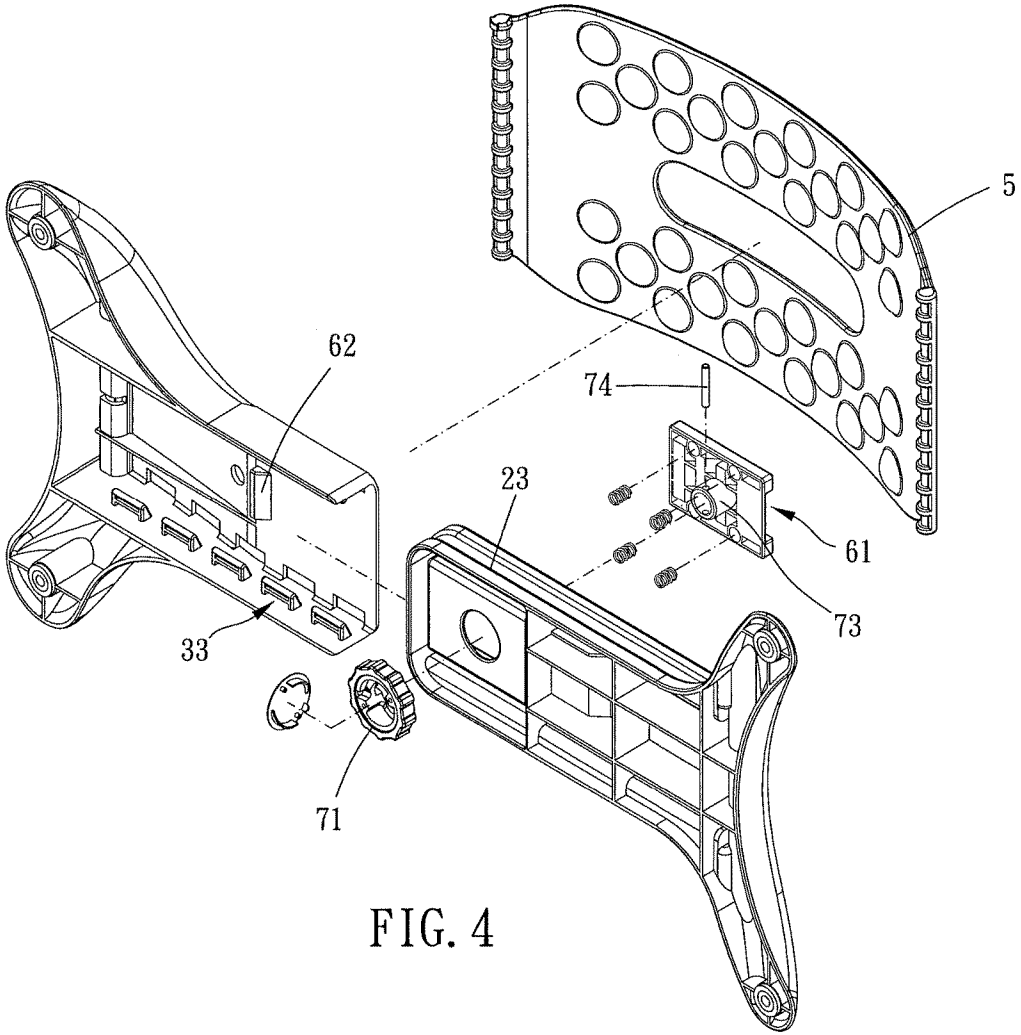

Please refer to FIG. 1 to FIG. 13, the exercise equipment of the present invention includes a base 1, a resilient element 5, and a positioning mechanism 6.

The base 1 has two bodies which are selectively movable with respect to each other. The two bodies are able to move along a moving path. Each of the bodies has a support portion 4 on the moving path for leaning against. Two sides of the resilient element 5 are connected to the two bodies respectively, and the resilient element 5 is arc-shaped and protruded. The resilient element 5 and each of the bodies are independent from each other to be single pieces. The positioning mechanism 6 includes a first positioning portion 61 and a second positioning portion 62 which are able to be selectively positioned to each other. The first positioning portion 61 is disposed on one of the bodies. The second positioning portion 62 is disposed on the other one of the bodies. The positioning mechanism 6 is switchable between a locking position and a release position. When the positioning mechanism 6 is located at the locking position, the first positioning portion 61 and the second positioning portion 62 are positioned to each other, and the two bodies are unable to move away from or toward each other along the moving path. When the positioning mechanism 6 is located at the release position, the two bodies are able to move along the moving path freely.

Figure 11:
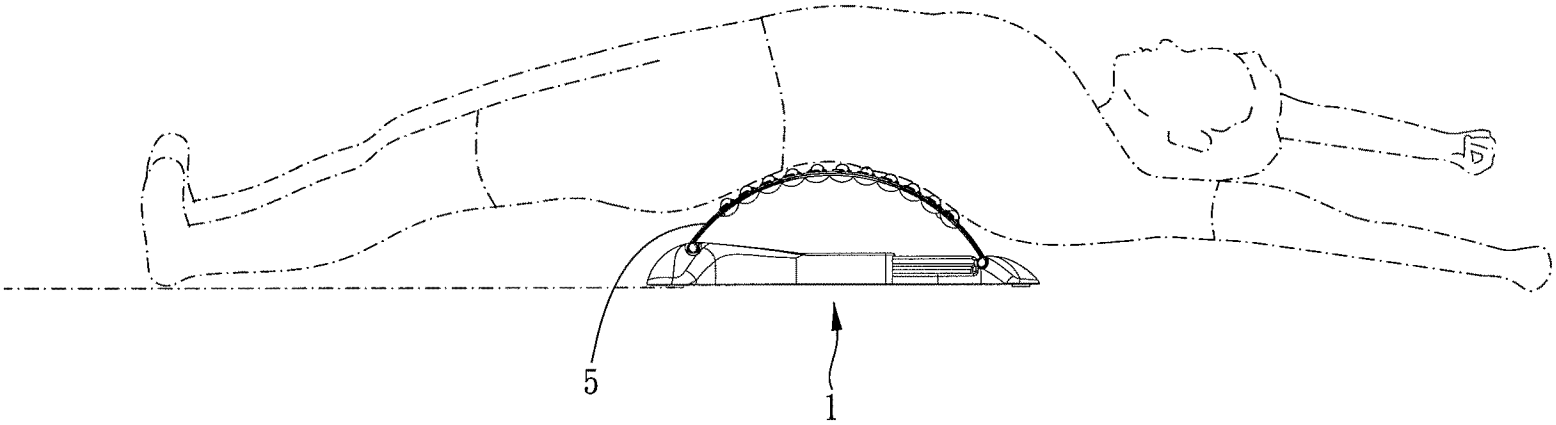
FIGS. 11 to 13 are illustrations of the present invention.
Figure 12:
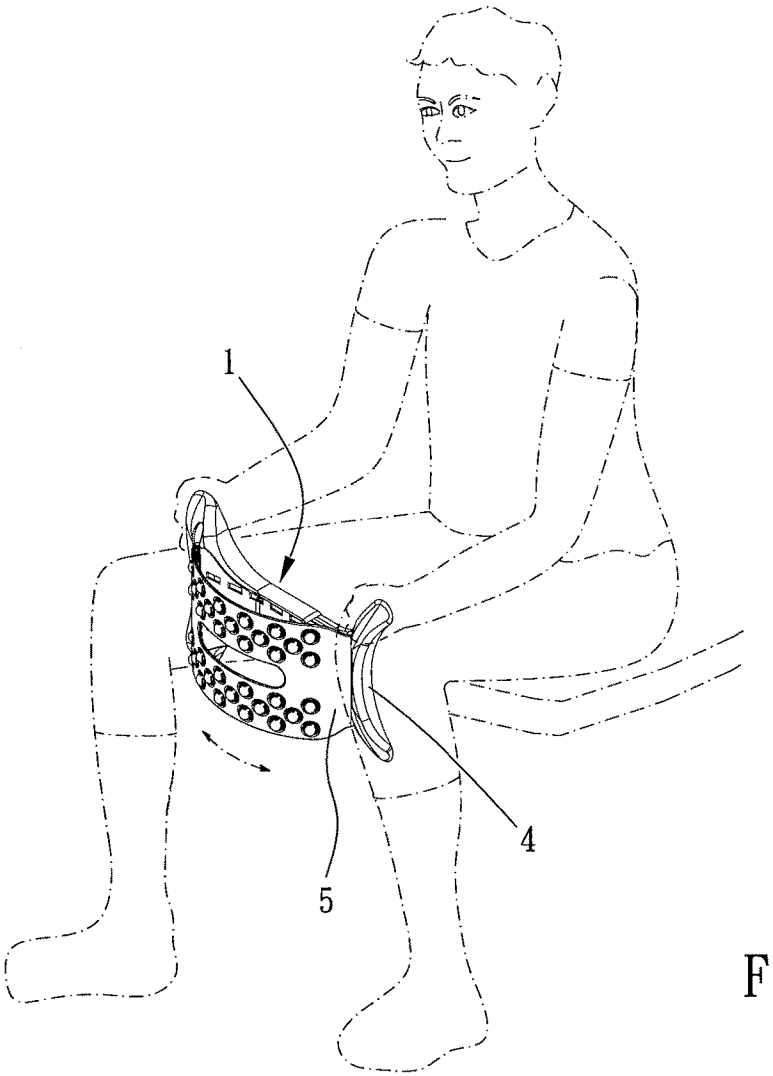
Figure 13:
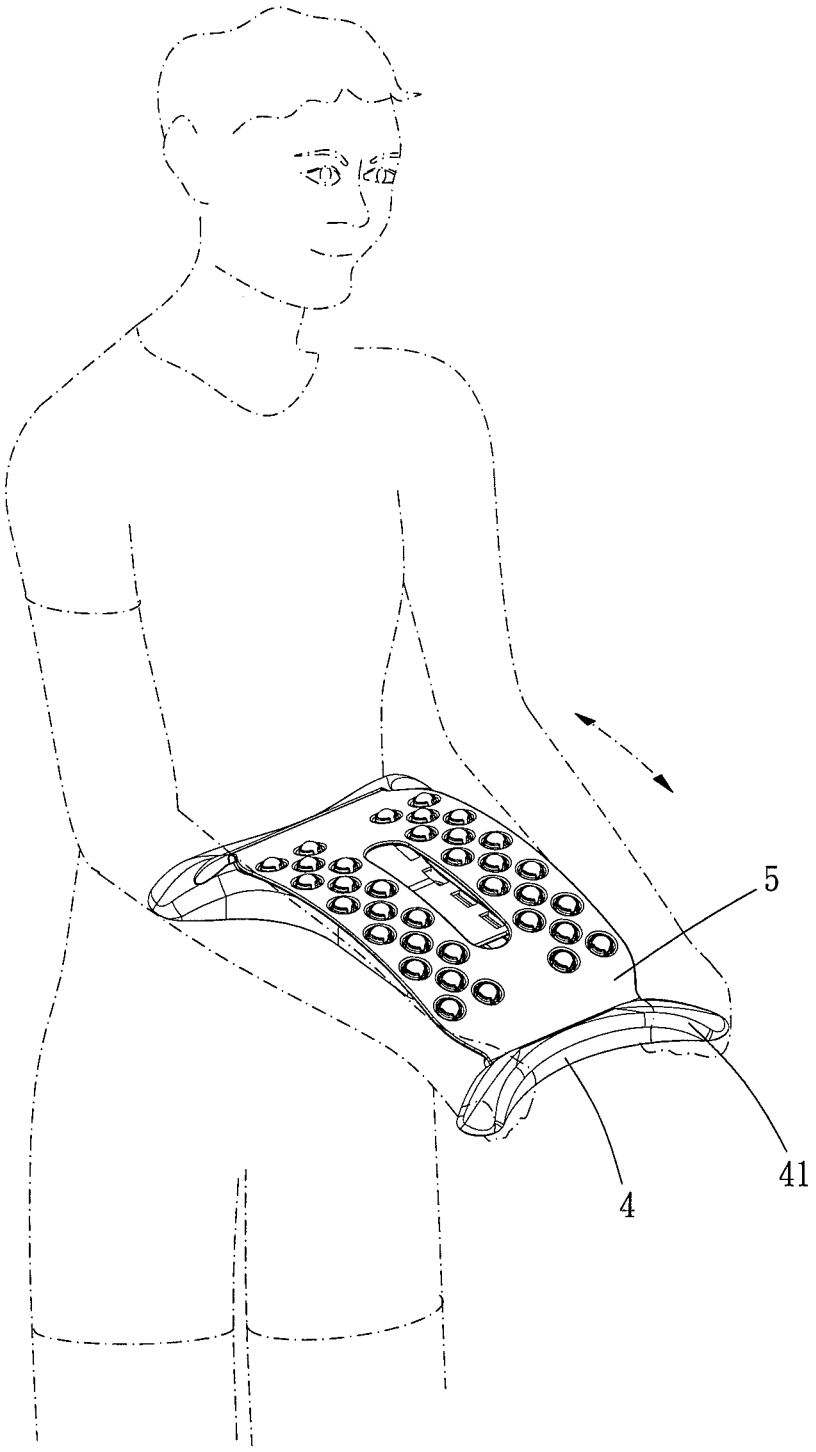

In the present embodiment, the moving path is a straight line. However, the moving path can be arc-shaped. The arc of the resilient element 5 can be changed by moving the two bodies. The steps of adjustment are shown in FIGS. 6 to 9. Preferably, the two ends of the resilient element 5 are pivotally connected to the two bodies to adjust the angle. Specifically, the resilient element 5 has a contact face 51. The user can lean against the contact face 51 with his back to stretch the dorsal muscle, as shown in FIG. 11. Preferably, a plurality of rolling balls 52 are disposed on the contact face 51 for massage. More preferably, the resilient element 5 is elastic to make the two bodies tend to be away from each other. Thus, when the positioning mechanism 6 is kept at the release position, the exercise equipment can be used for repeating training, such as placing between the two legs to train the muscle of legs (FIG. 12) or placing on the belly and pressing by hand to train the abdominal muscle (FIG. 13).

When seeing along a direction perpendicular to the moving path, each of the support portions 4 is arc-shaped and recessed. The recessed portion provides space to receive part of the human body to fit the human body. Each of the support portions 4 has two leg portion 41 for standing on the ground or holding by hands. Each leg portion 41 has an arc face 42. The arc face 42 and the resilient element 5 are located at a same side of the exercise equipment. When the leg portions 41 are held by hands, the shape fits the bending hand.

More specifically, in the present embodiment, the first positioning portion 61 has a plurality of protruding ribs 64. The protruding ribs 64 are arranged along the moving path to define a plurality of grooves 67. When the positioning mechanism 6 is located at the locking position, the second positioning portion 62 is inserted into one of the grooves 67 to be positioned to one of the protruding ribs 64. When the positioning mechanism 6 is located at the release position, the first and the second positioning portions 61,62 are separated from each other.

More specifically, each protruding rib 64 has a vertical wall 65 and an inclined wall 66 connected to each other. The second positioning portion 62 is arranged opposite to the protruding ribs 64. The vertical wall 65 is perpendicular to the moving path, and the inclined wall 66 traverses the moving path. When the positioning mechanism 6 is located at the locking position and the two bodies are moving away from each other, the vertical wall 65 abuts against the second positioning portion 62. When the positioning mechanism 6 is located at the locking position and the two bodies are moving toward each other, the second positioning portion 62 is guided to enter an other one of the grooves 67 by the inclined wall 66. That is, when the positioning mechanism 6 is located at the locking position, the two bodies can move toward each other. In other possible embodiments, the protruding ribs can be arranged oppositely, or the protruding ribs can be fixed to the second positioning portion to prohibit the movement of the two bodies.

Preferably, the positioning mechanism 6 further includes an operation unit 7. The operation unit 7 is connected to at least one of the first positioning portion 61 and the second positioning portion 62. The operation unit 7 is adapted for operation to control the first positioning portion 61 and the second positioning portion 62 to be positioned to each other or to separate from each other.

In the present embodiment, the two bodies includes a first body 2 and a second body 3. The first positioning portion 61 is movably disposed on the first body 2 and is movable along a direction traversing the moving path. The second positioning portion 62 is fixed to the second body 3. The positioning mechanism 6 further includes at least one abutting element 63. The abutting element 63 connects the first positioning portion 61 and the first body 2 so that the first positioning portion 61 tends to move toward the second positioning portion 62 to be positioned to the second positioning portion 62. The operation unit 7 is connected to the first positioning portion 61 for operation to make the first positioning portion 61 push the abutting element 63 to be away from the second positioning portion 62.

Figure 5:
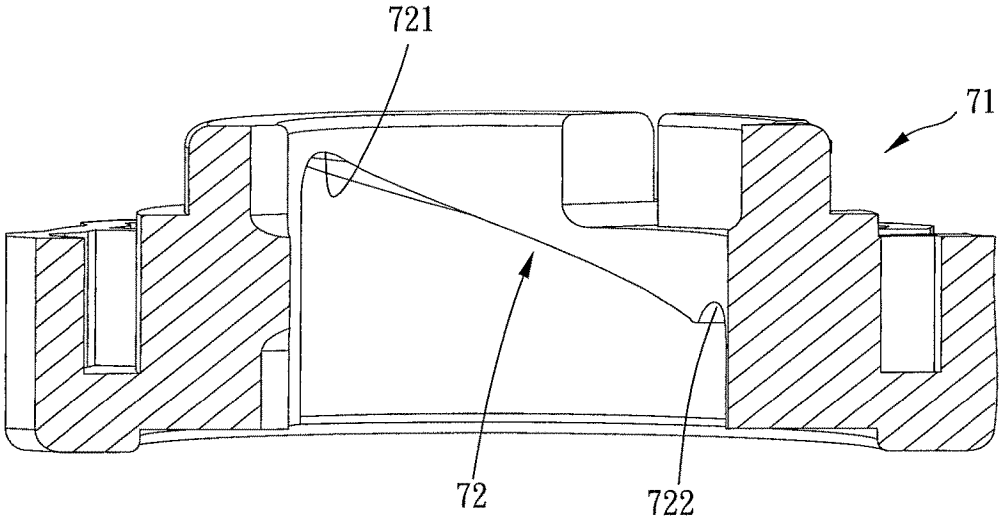
FIG. 5 is a partial enlargement of a switch element of the present invention.
Figure 6:
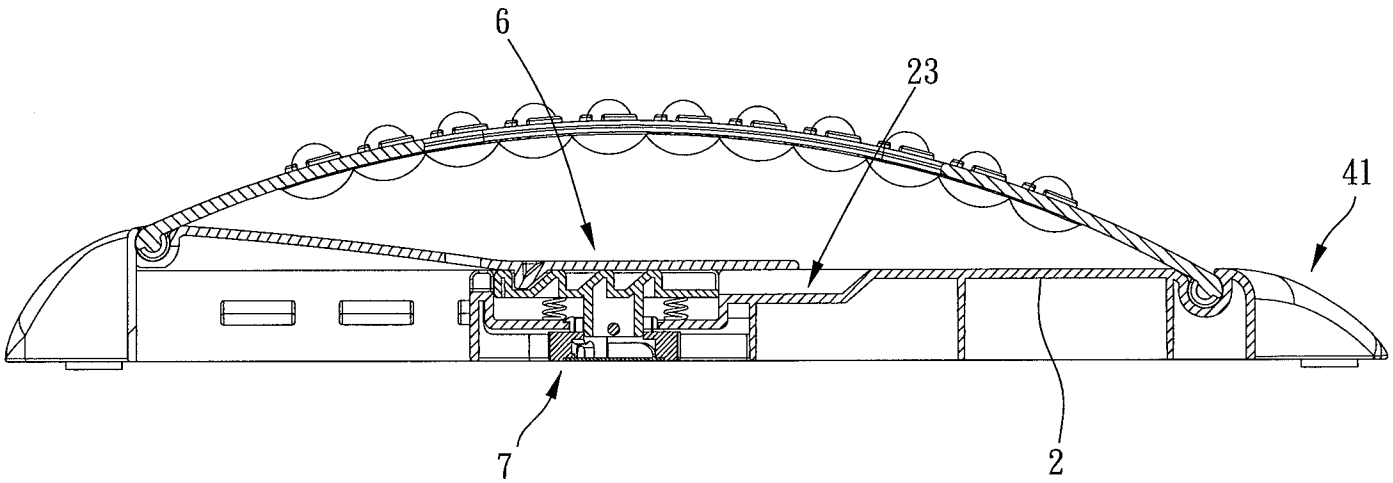
FIGS. 6 to 9 are illustrations of the present invention.
Figure 7:
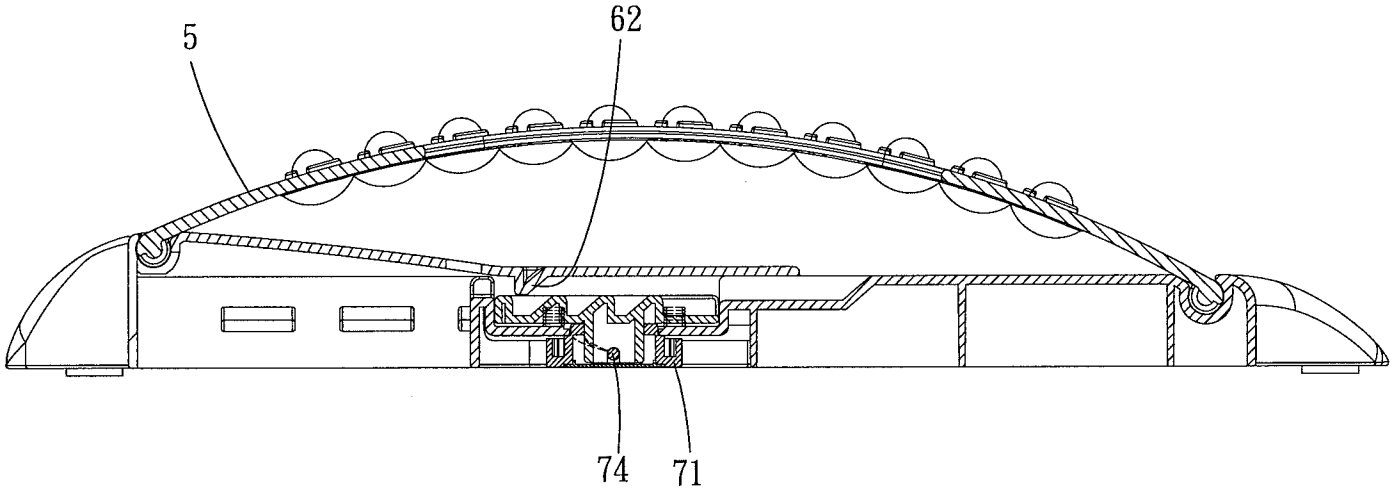
Figure 8:
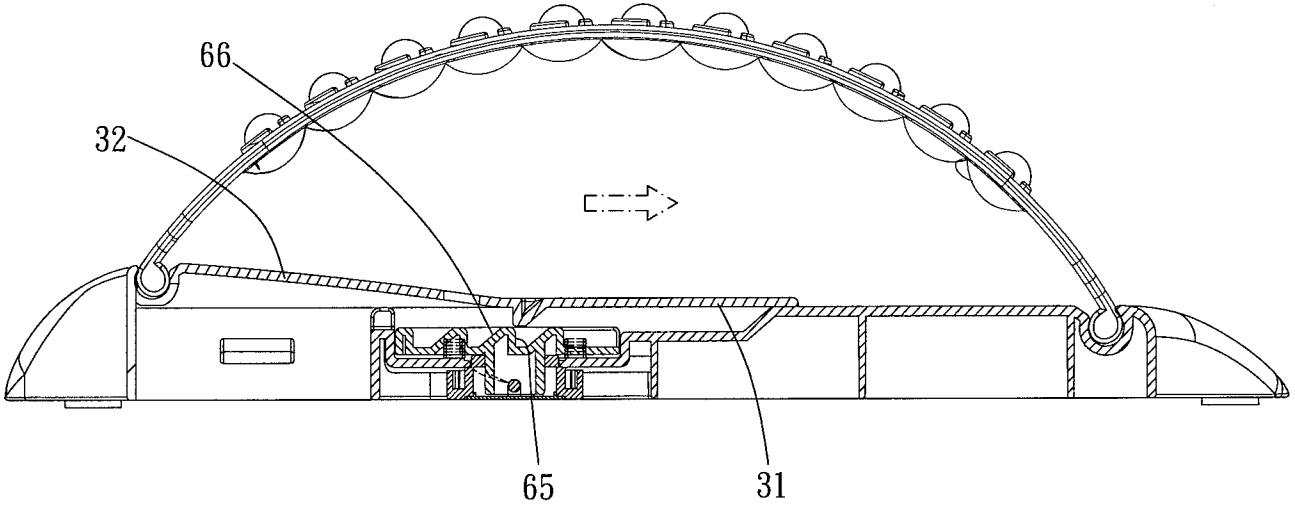
Figure 9:
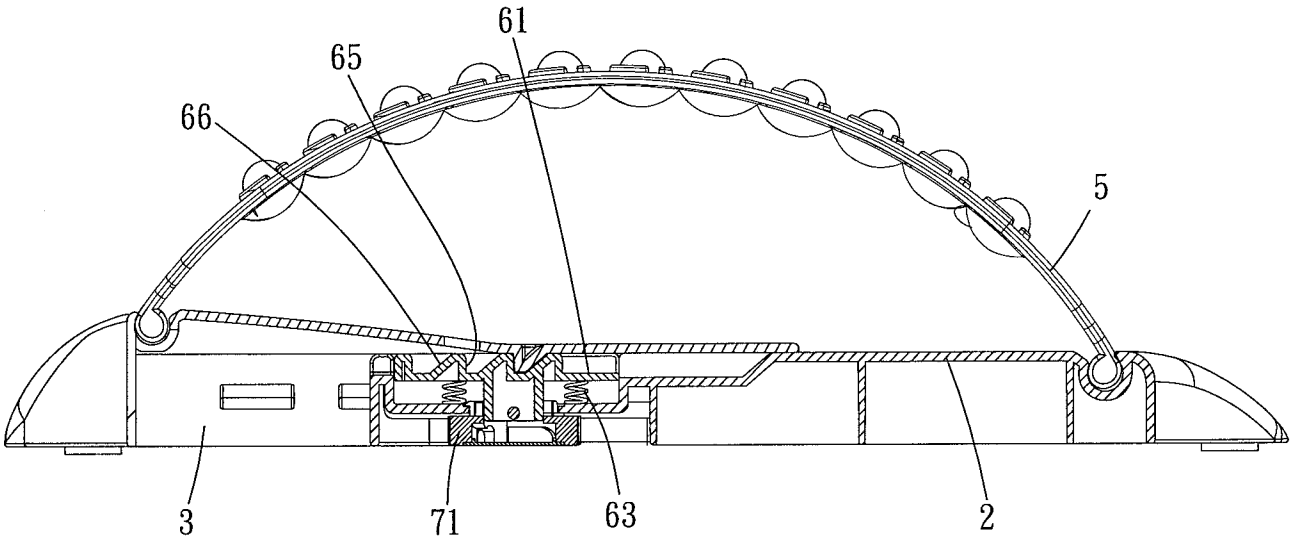
Figure 10:
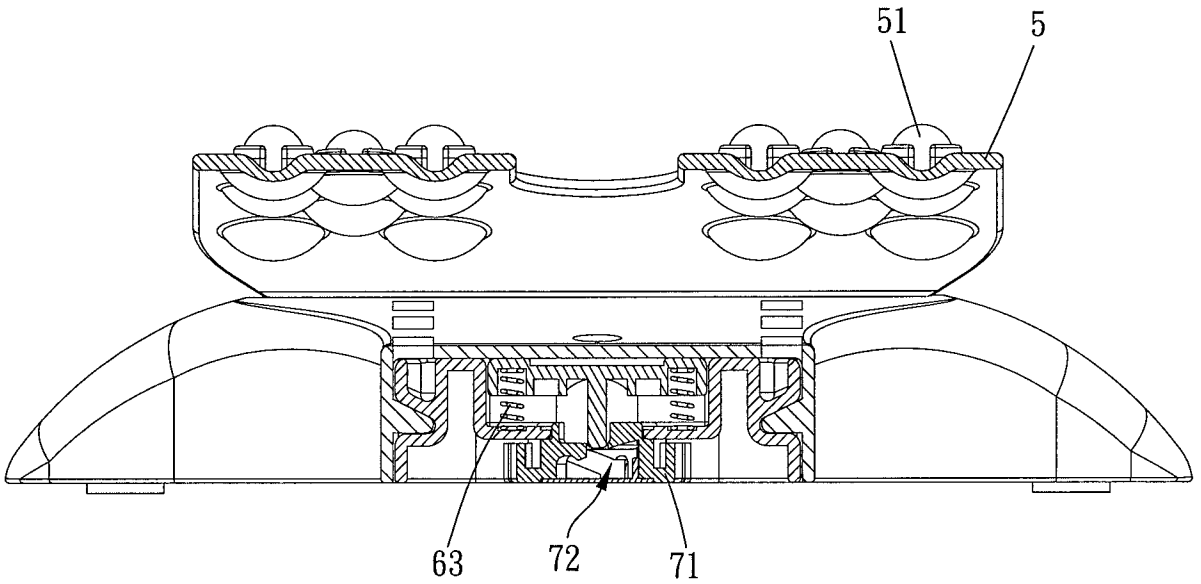
FIG. 10 is a profile of FIG. 9 at another angle.

The operation unit 7 has a switch element 71, a connecting element 73, and a pin 74. The switch element 71 is rotatably disposed on the first body 2. The switch element 71 has two guiding portions 72. Each guiding portion 72 has a first abutting portion 721 and a second abutting portion 722, as shown in FIG. 5. Along the direction traversing the moving path, the first abutting portion 721 is located between the second abutting portion 722 and the abutting element 63. Part of the connecting element 73 is connected to the first positioning portion 61. The pin 74 is inserted through the connecting element 73. Two ends of the pin 74 slidably abut against the two guiding portions 72 respectively. When the two ends of the pin 74 is located at the first abutting portion 61, the first positioning portion 61 and the second positioning portion 62 are positioned to each other, as shown in FIG. 6. When the two ends of the pin 74 is located at the second abutting portion 722, the first positioning portion 61 and the second positioning portion 62 are separated from each other, as shown in FIG. 7.

Specifically, one of the two bodies has a sliding rail portion 21, and the other one of the two bodies has a sliding portion 33 slidably disposed on the sliding rail portion 21 to quickly move the two bodies. In the present embodiment, the first body 2 has a sliding rail portion 21, and the second body 3 has a sliding portion 33 slidably disposed on the sliding rail portion 21. When seeing along the moving path, the second body 3 is reversed U-shaped, and the first body 2 is slidably inserted into the second body 3. The sliding portion 33 includes a plurality of protrusions arranged spacedly.

In addition, the first body 2 is further formed with a receiving groove 22 and a moving groove 23. The receiving groove 22 communicates the moving groove 23 along the moving path. The moving groove 23 is located between the receiving groove 22 and the second body 3. The moving groove 23 and the receiving groove 22 are stepped-shape arranged. The first positioning portion 61 and the abutting element 63 are restricted in the receiving groove 22. The second positioning portion 62 is slidable between the receiving groove 22 and the moving groove 23 along the moving path. The second body 3 has a first section 31 and a second section 32. The first section 31 covers the receiving groove 22. The second section 32 is obliquely connected to the first section 31. The second positioning portion 62 is located between the first section 31 and the second section 32.

In conclusion, quick adjustment of position can be achieved by the two bodies slidably connected to adjust the bending of the resilient element. In addition, the first positioning portion and the second positioning portion can be easily positioned or separated by rotating the switch element. Besides, the equipment can be used for dorsal stretching or reciprocating training.

What is claimed is:

1. An exercise equipment, including:

a base having two bodies which are selectively movable with respect to each other, the two bodies configured to move along a moving path, each of the two bodies comprising a support portion on the moving path;

a resilient element, two sides of the resilient element being connected to the two bodies respectively, the resilient element being arc-shaped and protruded, the resilient element and each of the bodies being independent from each other to be single pieces;

a positioning mechanism comprising a first positioning portion and a second positioning portion which are able to be selectively positioned with respect to each other, the first positioning portion being disposed on one of the two bodies and the second positioning portion being disposed on the other one of the two bodies and wherein the positioning mechanism is configured to be switchable between a locking position and a release position;

wherein when the positioning mechanism is at the locking position, the first positioning portion and the second positioning portion are fixed in relation to each other, and the two bodies are unable to move away from or toward each other along the moving path;

wherein when the positioning mechanism is at the release position, the two bodies are able to move along the moving path freely.

2. The exercise equipment of claim 1, wherein the positioning mechanism further includes an operation unit, the operation unit is connected to at least one of the first positioning portion and the second positioning portion, the operation unit is configured to selectively position and lock the first positioning portion against the second positioning portion.

3. The exercise equipment of claim 2, wherein the two bodies comprises a first body and a second body; wherein the first positioning portion is movably disposed on the first body, and the second positioning portion is fixed to the second body; wherein the positioning mechanism further includes at least one abutting element, the at least one abutting element connects the first positioning portion and the first body so that the first positioning portion is biased toward the second positioning portion to be positioned to the second positioning portion, and the operation unit is connected to the first positioning portion and configured to selectively push the abutting element away from the second positioning portion.

4. The exercise equipment of claim 3, wherein the operation unit has a switch element, a connecting element, and a pin, and wherein the switch element is rotatably disposed on the first body, the switch element has two guiding portions, each of the two guiding portions has a first abutting portion and a second abutting portion; along the direction traversing the moving path, the first abutting portion is located between the second abutting portion and the abutting element, part of the connecting element is connected to the first positioning portion, the pin is inserted through the connecting element, two ends of the pin slidably abut against the two guiding portions respectively, when the two ends of the pin are located at the first abutting portion, the first positioning portion and the second positioning portion are positioned to each other, when the two ends of the pin are located at the second abutting portion, the first positioning portion and the second positioning portion are separated from each other.

5. The exercise equipment of claim 4, wherein the moving path is a straight line; the resilient element is elastic and configured to bias the two bodies away from each other, the resilient element has a contact face, the contact face comprises a plurality of rolling balls; when viewed along a direction perpendicular to the moving path, each of the support portions is arc-shaped and recessed; and each of the support portions has two leg portions, wherein each of the two leg portions has an arc face, the arc faces and the resilient element are located at a same side face of the base; the first body has a sliding rail portion, the second body has a sliding portion slidably disposed on the sliding rail portion; when viewed along the moving path the second body is reversed U-shaped, and the first body is slidably inserted into the second body, the sliding portion includes a plurality of protrusions arranged spacedly; the first body is further formed with a receiving groove and a moving groove, the receiving groove communicates the moving groove along the moving path, the moving groove is located between the receiving groove and the second body, the moving groove and the receiving groove are stepped-shape arranged; wherein the first positioning portion and the abutting element are restricted in the receiving groove, and the second positioning portion is slidable between the receiving groove and the moving groove along the moving path; the second body has a first section and a second section, the first section covers the receiving groove, the second section is obliquely connected to the first section, the second positioning portion is located between the first section and the second section; the first positioning portion has a plurality of protruding ribs, the plurality of protruding ribs are arranged along the moving path to define a plurality of grooves; wherein when the positioning mechanism is at the locking position, the second positioning portion is inserted into one of the plurality of grooves to be positioned to one of the plurality of protruding ribs, when the positioning portion is at the release position, the first and the second positioning portions are separated from each other; wherein each of the plurality of protruding rib has a vertical wall and an inclined wall connected to each other, the second positioning portion is arranged opposite to the plurality of protruding ribs, the vertical wall is perpendicular to the moving path; wherein the inclined wall traverses the moving path, when the positioning mechanism is at the locking position and the two bodies are moving away from each other, the vertical wall abuts against the second positioning portion, and when the positioning mechanism is at the locking position and the two bodies are moving toward each other, the second positioning portion is guided to enter an other one of the plurality of grooves by the inclined wall.

6. The exercise equipment of claim 1, wherein the first positioning portion has a plurality of protruding ribs, the plurality of protruding ribs are arranged along the moving path to define a plurality of grooves; wherein when the positioning mechanism is at the locking position, the second positioning portion is inserted into one of the plurality of grooves and is positionably engaged with one of the plurality of protruding ribs, and wherein when the positioning mechanism is at the release position, the first and the second positioning portions are separated from each other.

7. The exercise equipment of claim 6, wherein each of the plurality of protruding ribs has a vertical wall and an inclined wall connected to each other; wherein the second positioning portion is arranged opposite to the plurality of protruding ribs, the vertical wall is perpendicular to the moving path, and the inclined wall traverses the moving path; and wherein when the positioning mechanism is at the locking position and the two bodies are moving away from each other, the vertical wall abuts against the second positioning portion, and wherein when the positioning mechanism is at the locking position and the two bodies are moving toward each other, the second positioning portion is guided to enter an other one of the plurality of grooves by the inclined wall.

8. The exercise equipment of claim 1, wherein one of the two bodies has a sliding rail portion, the other one of the two bodies has a sliding portion slidably disposed on the sliding rail portion.

9. The exercise equipment of claim 1, wherein the resilient element is elastic and configured to bias the two bodies away from each other.

10. The exercise equipment of claim 1, wherein when viewed along a direction perpendicular to the moving path, each of the support portions is arc-shaped and recessed; each of the support portions has two leg portions, each of the two leg portion has an arc face, the arc faces and the resilient element are located at a same side face of the base.

* * * * *